US005399218A

United States Patent [19]

Harrison et al.

[11] Patent Number: 5,399,218

[45] Date of Patent: Mar. 21, 1995

[54] PROCESS FOR MAKING EXTRUDED RECEIVER AND CARRIER LAYER FOR RECEIVING ELEMENT FOR USE IN THERMAL DYE TRANSFER

[75] Inventors: Daniel J. Harrison; Jong S. Lee, both of Pittsford, N.Y.

[73] Assignee: Eastman Kodak Company, Rochester, N.Y.

[21] Appl. No.: 142,780

[22] Filed: Oct. 26, 1993

[51] Int. Cl.[6] ..... B41M 5/035; B41M 5/26

[52] U.S. Cl. ..... 156/229; 503/227; 428/910; 428/914; 428/318.4; 428/315.5

[58] Field of Search ..... 156/229; 503/227; 428/318.4, 910, 914, 315.5

[56] References Cited

U.S. PATENT DOCUMENTS

| | | | |
|---|---|---|---|
| 3,894,904 | 7/1975 | Cook | 156/229 X |
| 4,097,645 | 6/1978 | Toyoda | 156/229 X |
| 4,695,286 | 9/1987 | Vanier et al. | 8/471 |
| 4,778,782 | 10/1988 | Ito | 503/227 X |
| 4,908,345 | 3/1990 | Egashira | 503/227 X |
| 4,912,085 | 3/1990 | Marbrow | 503/227 |
| 4,943,555 | 7/1990 | Nakamoto | 503/227 X |
| 4,999,335 | 3/1991 | Mruk | 503/227 X |
| 5,011,814 | 4/1991 | Harrison | 503/227 |
| 5,055,371 | 10/1991 | Lee | 156/229 X |
| 5,096,875 | 3/1992 | Martin | 430/551 X |
| 5,100,862 | 3/1992 | Harrison | 503/227 X |
| 5,135,905 | 8/1992 | Egashira | 503/227 X |
| 5,196,391 | 3/1993 | Ohno | 503/200 X |
| 5,244,861 | 9/1993 | Campbell | 503/227 X |
| 5,250,496 | 10/1993 | Warner | 503/227 X |
| 5,268,348 | 12/1993 | Egashira | 503/227 X |
| 5,268,349 | 12/1993 | Ohno | 503/227 X |
| 5,288,690 | 2/1994 | Warner | 503/227 X |

*Primary Examiner*—David A. Simmons
*Assistant Examiner*—Charles Rainwater
*Attorney, Agent, or Firm*—Harold E. Cole

[57] ABSTRACT

A process for making a thermal dye transfer receiver element comprising:

a) coextruding a dye image-receiving layer with an orientable thermoplastic resin to form a cast film;

b) stretching the cast film to reduce the thickness of the dye image-receiving layer and to produce an oriented composite film; and c) laminating the oriented composite film to a support.

15 Claims, No Drawings

PROCESS FOR MAKING EXTRUDED RECEIVER AND CARRIER LAYER FOR RECEIVING ELEMENT FOR USE IN THERMAL DYE TRANSFER

This invention relates to a process for making dye-receiving elements used in thermal dye transfer, and more particularly to receiving elements made by coextruding a dye image-receiving layer and an orientable thermoplastic resin carrier layer prior to stretching and laminating to a support.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

U.S. Pat. No. 4,695,286 discloses dye-receiving elements used in thermal dye transfer which comprise a polymeric dye image-receiving layer coated on a base or support. These dye image-receiving layers have typically been applied to a receiver support by a solvent coating process. There is a problem with solvent coating processes, however, in that they are rather expensive and create environmentally unfriendly waste products such as solvent based solutions as well as solvent vapor.

U.S. Ser. No. 801,223 of Daly, filed Dec. 3, 1991, discloses extrudable receiver layers. While these receiver polymers eliminate the solvent coating disadvantages, there is a problem with these materials in that it is difficult to apply them in thin layers onto receiver supports. Receiver layer thicknesses produced by the solvent coating process are on the order of 1–10 μm. Typically the minimum layer thickness for an extruded film is 25 μm. Receiver layer polymers are rather expensive to produce and need not be present at a thickness of more than 10 μm.

U.S. Pat. No. 4,912,085 discloses that receiver layers can be coextruded with thermoplastic receiver supports and then stretched. However, this technique is limited since it can only be applied to supports which can be stretched. It is an object of this invention to provide a technique which could be applied to non-stretchable supports such as paper.

U.S. Pat. No. 5,244,861, dye-receiving elements are disclosed wherein a dye image-receiving layer is coated onto a composite film laminated to a support. The composite film comprises a microvoided thermoplastic core layer and at least one substantially void-free thermoplastic surface layer. There is a problem with this technique in that the dye image-receiving layer is solvent coated onto the support with the disadvantages noted above.

It is an object of the invention to provide a process for preparing receiving elements with both the ecological and cost advantages of film extrusion. It is another object of the invention to provide a process for preparing receiving elements with thin dye receiving layers. It is still another object of this invention to provide a process for preparing receiving elements which are formed on stretchable as well as non-stretchable supports such as paper.

These and other objects are achieved in accordance with this invention, which comprises a process for making a thermal dye transfer receiver element comprising:

a) coextruding a dye image-receiving layer with an orientable thermoplastic resin to form a cast film;
b) stretching the cast film to reduce the thickness of the dye image-receiving layer and to produce an oriented composite film; and
c) laminating the oriented composite film to a support.

The cast film is formed by coextruding an orientable thermoplastic resin such as a semicrystalline polymer, which may optionally be filled with void-initiating organic or inorganic particles, with a dye image-receiving material onto a chilled casting drum. The quenched composite film is then biaxially oriented by stretching in mutually perpendicular directions at a temperature above the glass transition temperature (Tg) of the polymers. If void-initiating particles are present, then voids are created around each of the particles in the core. The film may be stretched in one direction and then in a second direction or may be simultaneously stretched in both directions.

After the cast film has been stretched, it is heat set to a temperature sufficient to crystallize the polymer while restraining to some degree the film against retraction in both directions of stretching. Non-microvoided films can be formed in a similar fashion by excluding the void-initiating particles from the core. While films without microvoids do not offer the same level of image uniformity improvement in thermal dye transfer receiver structures, they can provide a significant improvement.

In this invention, the receiving layer polymer is stretched, thus thinning the expensive receiver polymer skin and, in the case of the carrier or core layer containing void-initiating particles, producing microvoids. This new composite film can then be laminated to either stretchable or non-stretchable receiver supports to complete a receiver element which does not require the expensive and environmentally unsound solvent coating step.

Composite films with thermal dye transfer receiver skins have a structure as shown below:

| |
|---|
| Dye Receiver Layer Skin |
| Optional Adhesive Tie Layer |
| Thermoplastic Core (with or without microvoids) |
| Optional Thermoplastic Layer |
| Optional Skin Layer |

It is possible to produce a simple two-layer composite structure with just a receiver layer skin and a thermoplastic core. However, it is difficult to prepare receiver polymers with sufficient adhesion to the thermoplastic core to remain attached to the core after the stretching process. To solve this problem, an adhesive tie layer can be coextruded between the receiver layer and the thermoplastic core. This tie polymer must have excellent adhesion to both the receiver polymer and the thermoplastic core to function well.

Examples of tie layers useful in the invention include polyester tie layers such as Admer AT 507® (Mitsui Petrochemicals America, Ltd.). These materials have been found to provide excellent adhesion between polyester dye receiver skins and polyolefin thermoplastic cores. It is often desirable to maintain symmetry in these coextruded composite film structures for a stable manufacturing process, therefore an optional thermoplastic layer and skin layer may be required on the backside of the core.

Other examples of tie layers useful in the invention include polyesters, polycarbonates, acrylic copolymers, polyolefins and oxidized polyolefins, polymethanes and polyamides. They may be employed at a coverage of at least about 0.1 $g/m^2$.

The core of the composite film should be from 15 to 95% of the total thickness of the film, preferably from 30 to 85% of the total thickness. The receiving layer should thus be from 5 to 85% of the film, preferably from 15 to 70% of the thickness. The density (specific gravity) of the composite film should be between 0.2 and 1.0 $g/cm^3$, preferably between 0.3 and 0.7 $g/cm^3$. As the core thickness becomes less than 30% or as the specific gravity is increased above 0.7 $g/cm^3$, the composite film starts to lose useful compressibility and thermal insulating properties. As the core thickness is increased above 85% or as the specific gravity becomes less than 0.3 $g/cm^3$, the composite film becomes less manufacturable due to a drop in tensile strength and it becomes more susceptible to physical damage. The total thickness of the composite film can range from 20 to 150 $\mu m$, preferably from 30 to 70 $\mu m$. Below 30 $\mu m$, the microvoided films may not be thick enough to minimize any inherent non-planarity in the support and would be more difficult to manufacture. At thicknesses higher than 70 $\mu m$, little improvement in either print uniformity or thermal efficiency are seen, and so there is little justification for the further increase in cost for extra materials.

"Void" is used herein to mean devoid of added solid and liquid matter, although it is likely the "voids" contain gas. The void-initiating particles which remain in the finished packaging film core should be from 0.1 to 10 $\mu m$ in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the film. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the solution is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenylaromatic compound having the general formula $Ar \times C(R)=CH_2$, wherein Ar represents an aromatic hydrocarbon radical, or an aromatic halohydrocarbon radical of the benzene series and R is hydrogen or the methyl radical; acrylate-type monomers include monomers of the formula $CH_2=C(R') \times C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2=CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the above crosslinked polymer include styrene, butyl acrylate, acrylamide, acrylonitrile, methyl methacrylate, ethylene glycol dimethacrylate, vinylpyridine, vinyl acetate, methyl acrylate, vinylbenzyl chloride, vinylidene chloride, acrylic acid, divinylbenzene, acrylamidomethylpropanesulfonic acid, vinyltoluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the product beads spanning the range of the original distribution of sizes. Other processes such as suspension polymerization, limited coalescence, directly yield very uniformly sized particles.

The void-initiating materials may be coated with a slip agent to facilitate voiding. Suitable slip agents or lubricants .include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension are preferred. As the slip agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties.

Suitable classes of thermoplastic polymers for the core matrix-polymer of the composite film include polyolefins, polyesters, polyamides, polycarbonates, cellulosic esters, polystyrene, polyvinyl resins, polysulfonamides, polyethers, polyimides, poly(vinylidene fluoride), polyurethanes, poly(phenylene sulfides), polytetrafluoroethylene, polyacetals, polysulfonates, polyester ionomers, and polyolefin ionomers. Copolymers and/or mixtures of these polymers can be used.

Suitable polyolefins for the core matrix-polymer of the composite film include polypropylene, polyethylene, polymethylpentene, and mixtures thereof. Polyolefin copolymers, including copolymers of ethylene and propylene are also useful.

Suitable polyesters for the core matrix-polymer of the composite film include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic acids, naphthalenedicarboxylic acid, succinic, glutaric, adipic, azelaic, sebacic, fumaric, maleic, itaconic, 1,4-cyclohexanedicarboxylic, sodiosulfoisophthalic acids and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. Nos. 2,465,319 and 2,901,466. Preferred continuous matrix polyesters are those having repeat units from terephthalic acid or naphthalenedicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene-dicarboxylic acid. Examples of such liquid crystal copolyesters are those disclosed in U.S. Pat. Nos. 4,420,607, 4,459,402 and 4,468,510.

Useful polyamides for the core matrix-polymer of the composite film include Nylon 6, Nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite films include cellulose nitrate, cellulose triacetate, cellulose diacetate, cellulose acetate propionate, cellulose acetate butyrate, and mixtures or copolymers thereof. Useful polyvinyl resins include poly(vinyl chloride), poly(vinyl acetal), and mixtures thereof. Copolymers of vinyl resins can also be utilized.

In a preferred embodiment of the invention, the thermoplastic materials used as the core for the composite films in this invention are propylene/ethylene copolymers manufactured by Eastman Chemicals Company. These polyolefins were compounded with 15 wt-% of 5 μm diameter polystyrene beads crosslinked with divinylbenzene and coated with colloidal silica. The process for preparing these materials and blends is described in U.S. Pat. No. 5,244,861.

Addenda may be added to the core matrix to improve the whiteness of these films. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the film or the manufacturability of the film.

The coextrusion, quenching, orienting, and heat setting of these composite films may be effected by any process which is known in the art for producing oriented film, such as by a flat film process or a bubble or tubular process. The flat film process involves extruding the blend through a slit dye and rapidly quenching the extruded web upon a chilled casting drum so that the core matrix polymer component of the film and the skin components(s) are quenched below their glass transition temperatures (Tg). The quenched film is then biaxially oriented by stretching in mutually perpendicular directions at a temperature above the glass transition temperature of the matrix polymers and the skin polymers. The film may be stretched in one direction and then in a second direction or may be simultaneously stretched in both directions.

After the film has been stretched it is heat set by heating to a temperature sufficient to crystallize the polymers while restraining to some degree the film against retraction in both directions of stretching.

The support to which the microvoided composite films are laminated as base for the dye-receiving element prepared by the process of the invention may be a polymeric, a synthetic paper, or a cellulose fiber paper support, or laminates thereof.

Preferred cellulose fiber paper supports include those disclosed in U.S. Pat. No. 5,250,496, the disclosure of which is incorporated by reference. When using a cellulose fiber paper support, it is preferable to extrusion laminate the microvoided composite films using a polyolefin resin. During the lamination process, it is desirable to maintain minimal tension of the microvoided packaging film in order to minimize curl in the resulting laminated receiver support. The backside of the paper support (i.e., the side opposite to the microvoided composite film and receiver layer) may also be extrusion coated with a polyolefin resin layer (e.g., from about 10 to 75 g/m$^2$), and may also include a backing layer such as those disclosed in U.S. Pat. Nos. 5,011,814 and 5,096,875, the disclosures of which are incorporated by reference. For high humidity applications (>50% RH), it is desirable to provide a backside resin coverage of from about 30 to about 75 g/m$^2$, more preferably from 35 to 50 g/m$^2$, to keep curl to a minimum.

In one preferred embodiment, in order to produce receiver elements with a desirable photographic look and feel, it is preferable to use relatively thick paper supports (e.g., at least 120 μm thick, preferably from 120 to 250 μm thick) and relatively thin microvoided composite films (e.g., less than 50 μm thick, preferably from 20 to 50 μm thick, more preferably from 30 to 50 μm thick).

In another embodiment of the invention, in order to form a receiver element which resembles plain paper, e.g. for inclusion in a printed multiple page document, relatively thin paper or polymeric supports (e.g., less than 80 μm, preferably from 25 to 80 μm thick) may be used in combination with relatively thin microvoided composite films (e.g., less than 50 μm thick, preferably from 20 to 50 μm thick, more preferably from 30 to 50 μm thick).

The dye image-receiving layer of the receiving elements prepared by the process of the invention may comprise, for example, a polycarbonate, a polyurethane, a polyester, poly(vinyl chloride), poly(styrene-co-acrylonitrile), poly(caprolactone) or mixtures thereof. Polyester receiver polymers as disclosed and described in Daly copending U.S. Ser. No. 801,223 are also useful in this invention. These polyesters are copolymers condensed from cyclohexanedicarboxylate and a 50/50 mole-% mixture of ethylene glycol and bisphenol-A-diethanol (COPOL)®. The dye image-receiving layer may be present in any amount which is effective for the intended purpose. In general, good results have been obtained at a concentration of from about 1 to about 10 g/m$^2$.

Dye-donor elements that are used with the dye-receiving element prepared by the process of the invention conventionally comprise a support having thereon a dye containing layer. Any dye can be used in the dye-donor employed with the receiving elements prepared according to the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements prepared according to the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage using the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

Example 1

Composite films were prepared by coextruding the structure shown below:

| Polymer | Extrusion Temp. |
|---|---|
| 64 μm Thick COPOL ® Dye Receiver Layer | 250° C. |
| 64 μm Thick Admer ® AT 507 Adhesive Tie Layer | 250° C. |
| 254 μm Thick Propylene/Ethylene Copolymer & Styrene/Divinylbenzene Microbeads | 307° C. |

These films were coextruded with the temperature profile shown above and cast onto a 9° C. chilled drum and quenched. They were then stretched 3.3 times in both the machine and cross directions at the temperatures shown in Table 1. The films were then heat set at the temperatures shown in Table 1 and rolled up onto a core. The film variations which were prepared are summarized in Table 1.

TABLE 1

Receiver Elements With Varying Core Layers
Receiver Material: COPOL ®
Tie layer: AT 507

| Sample # | Core Layer | Temperature (°C.) Stretch | Heat Set |
|---|---|---|---|
| 1 | P5-001 (94.5% propylene/5.5% ethylene) | 105 | 111 |
| 2 | P4-005 (100% propylene) | 145 | 150 |
| 3 | P6-008 (87.5% propylene/12.5% ethylene) | 135 | 140 |
| 4 | P5-003 (99.6% propylene/0.4% ethylene) | 146 | 150 |

Each of these films was then extrusion-laminated onto a support with polyethylene (12 g/m$^2$) containing anatase titanium dioxide (13 wt. %) and a stilbene-benzoxazole optical brightner (0.03 wt. %). The support was a paper stock (120 μm thick, made from a 1:1 blend of Pontiac Maple 51 (a bleached maple hardwood kraft of 0.5 mm length weighted average fiber length), Consolidated Pontiac, Inc.) and Alpha Hardwood Sulfite (a bleached red alder hardwood sulfite of 0.69 mm average fiber length Weyerhaeuser Paper Co.). The backside of the stock support was extrusion coated with high density polyethylene (25 g/m$^2$).

Magenta dye containing thermal dye transfer donor elements were prepared by coating on 6 μm poly(ethylene terephthalate) support:

a) a subbing layer of Tyzor TBT ® (a titanium tetra-n-butoxide) (duPont Co.) (0.12 g/m$^2$) from 1-butanol; and b) a dye-layer containing the magenta dyes illustrated below (0.12 and 0.13 g/m$^2$) and S-363 (Shamrock Technologies, Inc.) (a micronized blend of polyolefin and oxidized polyolefin particles) (0.016 g/m$^2$), in a cellulose acetate propionate binder (2.5% acetyl, 45% propionyl) (0.40 g/m$^2$) from a toluene, methanol, and cyclopentanone solvent mixture.

On the backside of the dye donor element was coated:

a) a subbing layer of Tyzor TBT ® (a titanium tetra-n-butoxide) (duPont Co.) (0.12 g/m$^2$) from 1-butanol; and b) a slipping layer of Emralon 329 ® (a dry film lubricant of poly(tetrafluoroethylene) particles) (Acheson Colloids Co.) (0.59 g/m$^2$), BYK-320 ® (a polyoxyalkylene-methyl alkyl siloxane copolymer)-(BYK Chemie USA)(0.006 g/m$^2$), PS-513 ® (an aminopropyl-dimethyl-terminated polydimethylsiloxane) (Petrarch Systems, Inc.) (0.006 g/m$^2$), S-232 (a micronized blend of polyethylene and carnauba wax particles (Shamrock Technologies, Inc.) (0.016 g/m$^2$) coated from a toluene, n-propyl acetate, 2-propanol and 1-butanol solvent mixture.

The magenta dye structures are:

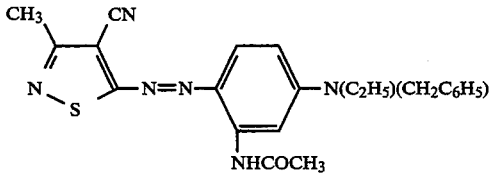

and

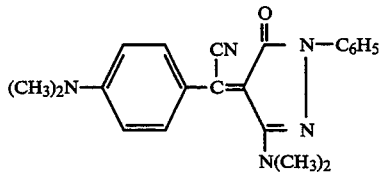

To evaluate relative printing efficiency using a thermal head, the dye-donors were printed at constant energy to provide a mid-scale test image on each dye-receiver. By comparison of the dye-densities produced at constant energy, the relative efficiency of transfer is comparable.

The dye side of the dye-donor element approximately 10 cm×15 cm in area was placed in contact with the polymeric receiving layer side of the dye-receiver element of the same area. The assemblage was fastened to the top of a motor-driven 56 mm diameter rubber roller and a TDK Thermal Head L-231 (No. 6-2R16-1), thermostated at 26° C., was pressed with a force of 36 Newtons against the dye-donor element side of the assemblage pushing it against the rubber roller.

The imaging electronics were activated and the assemblage was drawn between the printing head and roller at 7 mm/sec. coincidentally, the resistive elements in the thermal print head were pulsed at 128 msec intervals (29 msec/pulse) during the 33 msec/dot printing time. The voltage supplied to the print head was approximately 23.5 v with a power of approximately 1.3 watts/dot and energy of 7.6 mjoules/dot to create a "mid-scale" test image of non-graduated density (in the range 0.5–1.0 density units) over an area of approximately 9 cm×12 cm. The Status A Green reflection density was read and recorded as the average of 3 replicates. The results are shown in Table 2.

TABLE 2

Relative Printing Efficiencies of Receiver Elements with Different Core Layers (see Table 1)

| Sample # | Status A Green Reflection Density |
|---|---|
| 1 | 0.71 |
| 2 | 0.44 |
| 3 | 0.68 |
| 4 | 0.34 |

As can be seen from the results in Table 2, the samples described in this invention can function as thermal dye transfer receivers. These samples were prepared using only coextrusion and lamination processes. The data show that thermal dye transfer receivers can be applied to supports as thin layers in a process not involving solvent coating.

Example 2

Composite films were prepared by coextruding the following structure:

| Polymer | Extrusion Temperature (°C.) |
|---|---|
| 64 μm Thick COPOL ® Dye Receiver Layer | 250 |
| Optional 64 μm Thick Admer ® AT 507 Tie Layer | 250 |
| 762 μm Thick Poly(Ethylene Terephthalate) | 282 |

These films were coextruded with the temperature profile shown above and cast onto a 9° C. chilled drum and quenched, then stretched 3.3 times in both the machine and cross directions at 105° C. They were then heat set at 110° C. and rolled up onto a core. The film variations which were prepared are described in Table 3.

TABLE 3

Receiver Elements With and Without Tie Layer on Poly(Ethylene Terephthalate) Core Layers. Receiver material: COPOL ®.

| Sample # | Tie Layer | Core Layer |
|---|---|---|
| 5 | none | Poly(Ethylene Terephthalate) |
| 6 | AT 507 | Poly(Ethylene Terephthalate) |

Each of these films was then hot melt laminated onto a support with a 76 μm thick sheet of a linear saturated polyester hot melt adhesive film (Bostik ® 10-304-2 from Bostik Corp.). The support was poly(ethylene terephthalate) (100 μm thick Estar supplied by Eastman Kodak Co.

The printing efficiencies were determined for these samples as in Example 1 except they were printed to full Dmax. The results are shown in Table 4.

TABLE 4

| Relative Printing Efficiencies of Receiver Elements Without and With a Tie Layer (see Table 3) | |
|---|---|
| Sample # | Status A Green Transmission Density |
| 5 | 1.54 |
| 6 | 1.31 |

As can be seen from the results in Table 4, the samples described in this invention can function as thermal dye transfer receivers. These samples were prepared using only coextrusion and lamination processes. These data show that thermal dye transfer receivers can be applied to supports as thin layers without the solvent coating process.

The invention has been described in detail with particular reference to preferred embodiments thereof, but it will be understood that variations and modifications can be effected within the spirit and scope of the invention.

What is claimed is:

1. A process for making a thermal dye transfer receiver element consisting essentially of the following steps:

a) coextruding a polymeric dye image-receiving layer with an orientable thermoplastic resin to form a cast film;

b) stretching said cast film to reduce the thickness of said dye image-receiving layer and to produce an oriented composite film; and c) laminating said oriented composite film to a support to produce said thermal dye transfer receiver.

2. The process of claim 1 wherein said orientable thermoplastic resin is a polyolefin.

3. The process of claim 1 wherein a tie layer is coextruded with said dye image-receiving layer and said orientable thermoplastic resin layer.

4. The process of claim 1 wherein said orientable thermoplastic resin is microvoidable.

5. The process of claim 1 wherein the thickness of said composite film is from 30 to 70 μm.

6. The process of claim 1 wherein said orientable thermoplastic resin layer comprises from 30 to 85% of the thickness of said composite film.

7. The process of claim 1 wherein the overall density of said composite film is from 0.3 to 0.7 g/cm$^3$.

8. The process of claim 1 wherein said support comprises a non-voided polymer film.

9. The process of claim 1 wherein said support comprises cellulose fiber paper.

10. The process of claim 9 wherein said paper support is from 120 to 250 μm thick and said composite film is from 30 to 50 μm thick.

11. The process of claim 9 further comprising a polyolefin backing layer on the side of the support opposite to said composite film.

12. The process of claim 11 wherein said polyolefin backing layer is present at a coverage of from 35 to 75 g/m$^2$.

13. The process of claim 12 wherein the thickness of said composite film is from 30 to 70 μm.

14. The process of claim 12 wherein said support is a cellulose fiber paper support from 120 to 250 μm thick and said composite film is from 30 to 50 μm thick.

15. The process of claim 1 wherein said orientable thermoplastic resin layer of said composite film comprises a microvoided and oriented thermoplastic polymer and a polymeric void-initiating material.

* * * * *